US008726974B2

(12) United States Patent
Barlow et al.

(10) Patent No.: US 8,726,974 B2
(45) Date of Patent: May 20, 2014

(54) IN-SITU GRAPHITE SHAPE CONTROL FOR IRON CASTINGS

(75) Inventors: James O. Barlow, Germantown Hills, IL (US); Marvin G. McKimpson, Metamora, IL (US); George B. Kokos, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 390 days.

(21) Appl. No.: 13/016,061

(22) Filed: Jan. 28, 2011

(65) Prior Publication Data

US 2011/0185993 A1 Aug. 4, 2011

Related U.S. Application Data

(60) Provisional application No. 61/299,577, filed on Jan. 29, 2010.

(51) Int. Cl.
*B22D 27/00* (2006.01)
*B22D 27/04* (2006.01)

(52) U.S. Cl.
USPC ..... 164/55.1; 164/57.1; 164/58.1

(58) Field of Classification Search
USPC ..... 164/55.1, 56.1, 57.1, 58.1
See application file for complete search history.

(56) References Cited

U.S. PATENT DOCUMENTS 4,807,728 A 2/1989 Suenaga et al.

FOREIGN PATENT DOCUMENTS

| | | |
|---|---|---|
| EP | 806996 | 11/1997 |
| GB | 1278031 | 6/1972 |
| JP | 56093851 | 7/1981 |
| JP | 57009852 | 1/1982 |
| JP | 58209443 | 12/1983 |
| JP | 1107958 | 4/1989 |
| JP | 6142896 | 5/1994 |
| JP | 7024564 | 1/1995 |
| JP | 9078178 | 3/1997 |
| JP | 9136502 | 5/1997 |
| JP | 2003053509 | 2/2003 |

*Primary Examiner* — Kevin P Kerns

(57) ABSTRACT

A method to produce cast iron articles with various graphite morphologies is disclosed that provides cast iron with tailored properties at different locations of the article. Flake graphite morphology is preferably created at locations requiring excellent thermal conductivity or lubricity. Spheroidal graphite morphology is preferably created at locations requiring excellent strength or mechanical fatigue life. These methods may be particularly valuable for the production of heavy duty diesel engine components.

13 Claims, 2 Drawing Sheets

IN-SITU GRAPHITE SHAPE CONTROL FOR IRON CASTINGS

TECHNICAL FIELD

Figure 1:
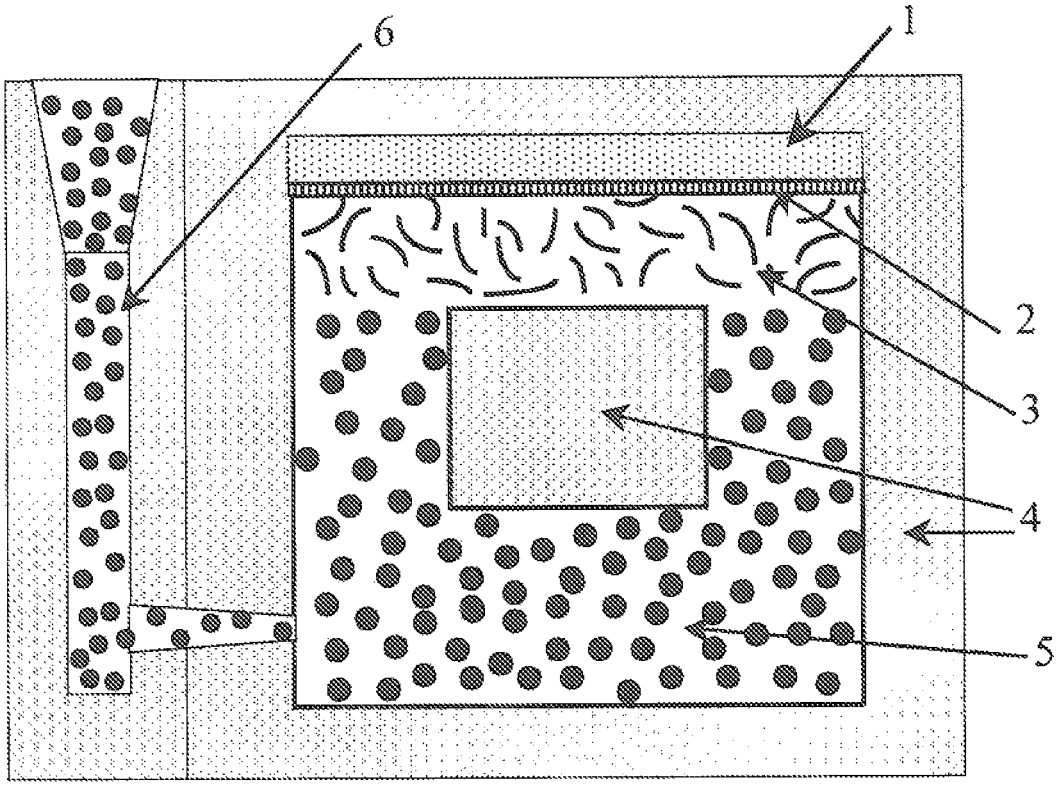

This disclosure relates to graphite morphology control in cast iron articles.

BACKGROUND

Cast iron articles can be manufactured with graphite morphology selected from a number of different shapes based on the mechanical, thermal, chemical, and tribological properties desired. Cast iron with flake graphite, called grey iron, exhibits excellent castability, good thermal conductivity, and excellent lubricity due to the graphite flakes. Cast iron with nodular graphite (also called spheroidal graphite) is generically called ductile iron due to its improved ductility over cast iron containing flake graphite. Ductile iron has better wear resistance and better tensile strength than cast iron with flake graphite. A third common graphite morphology is vermicular graphite (also called compacted graphite) which bridges nodular graphite and flake graphite. It is characterized by interconnected networks of thickened and rounded flakes within an iron matrix. Vermicular graphite cast iron (also called compacted graphite iron, CGI) has properties between that of ductile iron and grey iron.

In any given cast iron article it may be desirable to have some regions with properties associated with one of the graphite morphologies and another region with properties associated with another of the graphite morphologies. For example, in an engine block, it may be desirable to have better lubricity (associated with flake graphite) at a cylinder wall but to have better strength (associated with spheroidal graphite) in-between cylinders. For another example, it may be desirable to have better thermal conductivity (associated with flake graphite) in a cylinder head at the flame deck but better mechanical fatigue strength (associated with spheroidal graphite) on the outward-facing side of a cylinder head casting.

Prior art reference GB 1278031A discloses the concept of generating flake graphite at a cylinder wall while retaining spheroidal graphite elsewhere in a cylinder block. This reference generates the morphology difference by incorporating sulfur-containing compounds in the mold sand or on the surface of the mold that counteract nodularizing elements such as magnesium, calcium, or cerium in the molten cast iron. This technology is disclosed to be effective in modifying graphite morphology at the cylinder wall but the thickness disclosed as being affected was only 1.5 mm. While this reference does disclose that a deeper affected zone would be desirable (~6 mm) no enablement was demonstrated.

Prior art reference JP 58-209443A discloses a similar treatment to mold sand as a means to generate flake graphite in the part. In addition to sulfur, the mold is covered with flake graphite; the disclosed affected depth is 0.5-3.0 mm.

Prior art reference JP 01-107958A discloses a mold that incorporates a region of low thermal conductivity; and, by using a cast iron with 0.012-0.02 wt % Mg, the region with slow cooling rate can be induced to form flake graphite. The thickness of the region with flake graphite is not disclosed. Prior art reference U.S. Pat. No. 4,807,728 discloses a related concept, but in that patent, the cast iron is a hyper-eutectic flaky graphite iron that is quickly cooled in one region; in the quickly-cooled region the graphite is much finer and substantially spheroidal.

Prior art reference JP 56-093851A discloses a cast iron article with regions of spheroidal graphite where the spheroidizing agent is placed directly in the mold at regions where the properties of spheroidal graphite are desired. The flake graphite regions are produced without any special treatment in the mold or in the molten iron.

Work conducted in conjunction with the present disclosure has shown that in-mold treatments of the type described in the prior art result in extensive mixing of the sulfurizing agent and thus are unable to produce localized graphite morphology control; despite what is disclosed in the prior art. In light of the persistent desire for localized graphite morphology control, an improved method for manufacturing cast iron articles with graphite morphology control is disclosed.

SUMMARY OF THE INVENTION

This disclosure relates to localized graphite morphology control using one or more of the following variables: in-situ treatment with sulfurizing agent, in-situ treatment with spheroidizing agent, pouring temperature control, and localized in-mold cooling rate control.

In another aspect of this disclosure, in-situ treatment with sulfurizing agent is designed with intentional latency. Whereas core wash treatments may become incorporated quickly and become evenly dispersed throughout the cast iron article, this disclosure proposes a system where sulfurizing agent is not incorporated into the cast iron article until some predetermined elapsed time after pouring. The latency period is defined as the time between pouring the molten iron into the mold and the time that the graphite morphology control agent is introduced into the molten iron.

In another aspect of this disclosure, graphite morphology control is used for cast iron engine parts such as cylinder heads, engine blocks, or cylinder liners. The reasons for using graphite morphology control may be different for the various components. For example, in a cylinder head it may be desirable to have flake graphite at the flame deck for the excellent thermal conductivity of grey iron while ductile iron may be desired at regions away from the flame deck for its mechanical fatigue strength. As another example, in an engine block it may be desirable to have flake graphite at the cylinder bore for grey iron's lubricity and ductile iron elsewhere for its tensile strength.

DETAILED DESCRIPTION

In one embodiment, a cast iron article is made with localized graphite morphology control using in-situ sulfurizing agent addition. The in-situ sulfurizing agent addition is achieved with intentional latency to prevent the sulfurizing agent from dispersing throughout the cast iron article. Casting simulations have shown that cast iron metal remains fluid and has sustained internal mixing for over 40 seconds after pouring for articles with dimensions of ~360 mm×~270 mm×~150 mm. This internal mixing requires that any localized graphite morphology control must begin only after internal mixing subsides. Therefore, sulfurizing agent addition must have intentional latency commensurate with the duration of internal mixing after pouring.

It is common to construct a mold for a cast iron article to include one or more internal cores. Traditionally, each core section is made with substantially the same materials and each section exhibits similar thermal conductivity. In the present disclosure, the core sections may be constructed with dissimilar materials; also the various core sections may exhibit dissimilar thermal conductivities.

In one embodiment, sulfurizing agent may be incorporated into a core section associated with the region of desired localized graphite morphology control. This core section may be coated with a core wash having a thickness and permeability such that the required intentional latency is achieved. The latency period may be affected by the particular sulfurizing agent selected, in particular a sulfurizing agent with a relatively lower melting or vaporization temperature may have a shorter latency period whereas a sulfurizing agent with a relatively higher melting or vaporization temperature may have a longer latency period. Alternatively, for a given sulfurizing agent, a relatively thinner core wash may have a shorter latency period whereas a relatively thicker core wash may have a longer latency period. The intentional latency period is selected to be commensurate with the time required for internal mixing to slow. The core wash may also dissolve and thus have an associated dissolution rate that affects the latency period. FIG. 1 shows a mold for a cast iron article containing multiple cores. The gate and riser system 6 introduces the cast iron into the mold. The mold is assembled from material that does not contain any sulfurizing agents 4 and at least one section that does contain sulfurizing agent 1. Spheroidal graphite morphology 5 forms at locations not affected by the sulfurizing agent. A core wash 2 is applied to the core section containing sulfurizing agent 1 The core wash 2 has a thickness and permeability selected to achieve the intentional latency period prior to sulfurization agent melting or vaporization and subsequent incorporation into the molten cast iron. The effect of the sulfurization agent is that flaky graphite 3 forms in molten iron that would otherwise form spheroidal graphite. Although a core wash is envisioned to be the preferred means to create the intentional latency period between cast iron pouring and sulfurization agent melting or vaporization, alternative barrier treatments are also possible. Alternative barrier treatments that may be substituted for the core wash include, but are not limited to: ceramic or vitreous felts, blankets, or fabrics; stratified core sand constructions where the sulfurizing agent is located in a section that is covered by a thin core sand section without sulfurizing agent; and sheets that are placed in-situ that must melt prior to exposure of the sulfurizing agent. Depending on the cooling rate of the mold and internal mixing dynamics, the desired latency period may typically range from as little as 10 seconds after the molten iron is poured into the mold (for small articles) to more than 90 seconds after the molten iron is poured into the mold (for large articles). The desired sulfur content of the iron in the flake graphite region is greater than 0.05%. The flake graphite extends not less than 6 mm into the article and not more than 25 mm into the article (as measured from the surface).

Acceptable sulfurizing agents include materials such as iron pyrites and other iron sulfides. Additional sulfurizing agents include materials such as elemental sulfur, sulfur-containing organic molecules (such as may be part of certain core binder systems, either as part of the resin chemistry, e.g. p-toluenesulfonic acid catalyzed furan resin binders, or as an additional agent), sulfur-containing acids and sulfur-containing salts. Although sulfurizing agents may be used alone, other materials may be added synergistically to increase the effectiveness of the sulfur-containing material. Therefore, the use of sulfurizing agents as disclosed in this application should be understood as referring not only to sulfur-containing materials but also to those materials that may increase the effectivity of the sulfur in the iron. Oxidizers are one example of such materials that may exert a synergistic influence; specifically iron oxides, copper oxides, antimony oxides, or nickel oxides are all capable as acting as oxidizers that increase the effectivity of sulfur in forming flake graphite. Therefore sulfurizing agents may comprise sulfur-containing materials alone or combinations of sulfur-containing materials with oxidizers. Preferably, the oxidizers may be part of a core wash applied over the core section containing sulfurizing agent 1.

In another embodiment, a cast iron article is made with localized graphite morphology control using in-situ spheroidizing treatment. The in-situ spheroidizing agent addition is achieved with intentional latency to prevent the spheroidizing agent from dispersing throughout the cast iron article. Internal mixing requires that any localized morphology control must begin only after mixing subsides. Therefore, in-situ spheroidizing agent addition must have intentional latency commensurate with the duration of internal mixing after pouring. This can be achieved by having a spheroidizing agent with a vaporizing or melting temperature below that of the cast iron melt. This spheroidizing agent may be contained in a core section that is covered by a barrier layer such as a core wash such that the vaporizing or melting temperature of the spheroidizing agent is reached after internal mixing subsides. The spheroidizing agent may be contained in stratified core sections designed for in-situ localized graphite morphology control. The melting or vaporization temperature of the spheroidizing agent and properties of the barrier layer determine the intentional latency period. In-situ localized graphite morphology control using a spheroidizing agent would be used in cases where the cast iron is formulated to form a generally flaky graphite microstructure where not otherwise modified in the mold.

The spheroidizing agent may be selected from alkaline earth metal containing materials, especially magnesium or magnesium-containing compounds such as ferrosilicon magnesium alloys, magnesium fluoride, and calcium magnesium fluoride. Also, rare earth metals, including particularly lanthanum and cerium containing materials may be used as spheroidizing agents. Additionally, mixtures of alkaline earth metal containing materials and rare earth metal containing materials may be used as spheroidizing agents.

In another embodiment, a cast iron article is made with localized graphite morphology control using properly selected melt temperature and localized mold cooling. In this embodied method, certain regions can be cooled more quickly than other regions by embedding metal stakes or cooling lines in the mold near regions where an accelerated cooling rate is desirable. Additionally, some regions can be cooled more slowly by placing low thermal conductivity inserts at or near certain locations of the mold. It is known that accelerated cooling rates in magnesium-containing cast iron can suppress flake graphite formation and enable spheroidal graphite formation whereas slow cooling rates can encourage complete flake graphite formation.

Figure 2:
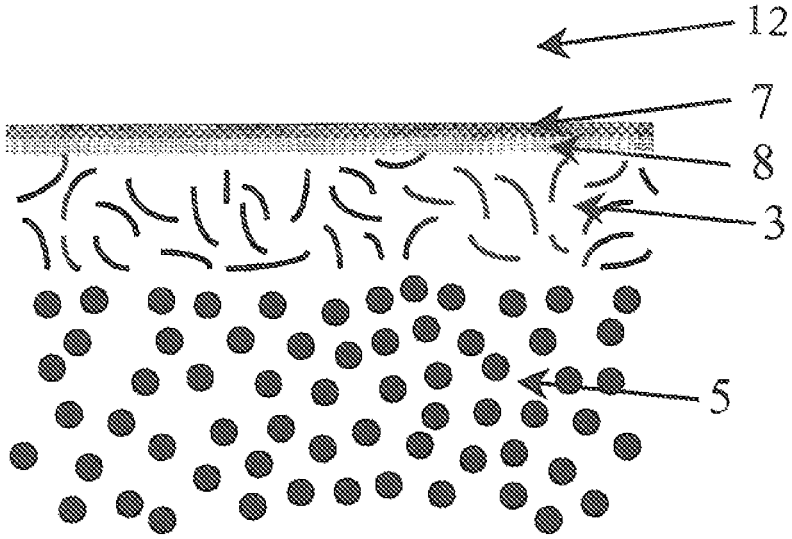

In another embodiment a sheet with localized graphite morphology control agent is placed in the mold. FIG. 2 shows a standard core material 12 that has placed over the surface a sheet of material having both a layer of graphite morphology control agent 7 and a layer 8 that creates latency between molten iron introduction into the mold and the incorporation of the graphite morphology control agent. Specifically, the graphite morphology control agent layer 7 may be comprised of one or more sulfurizing agents and layer 8 may be metal foil, the metal may preferably be steel.

Figure 3:
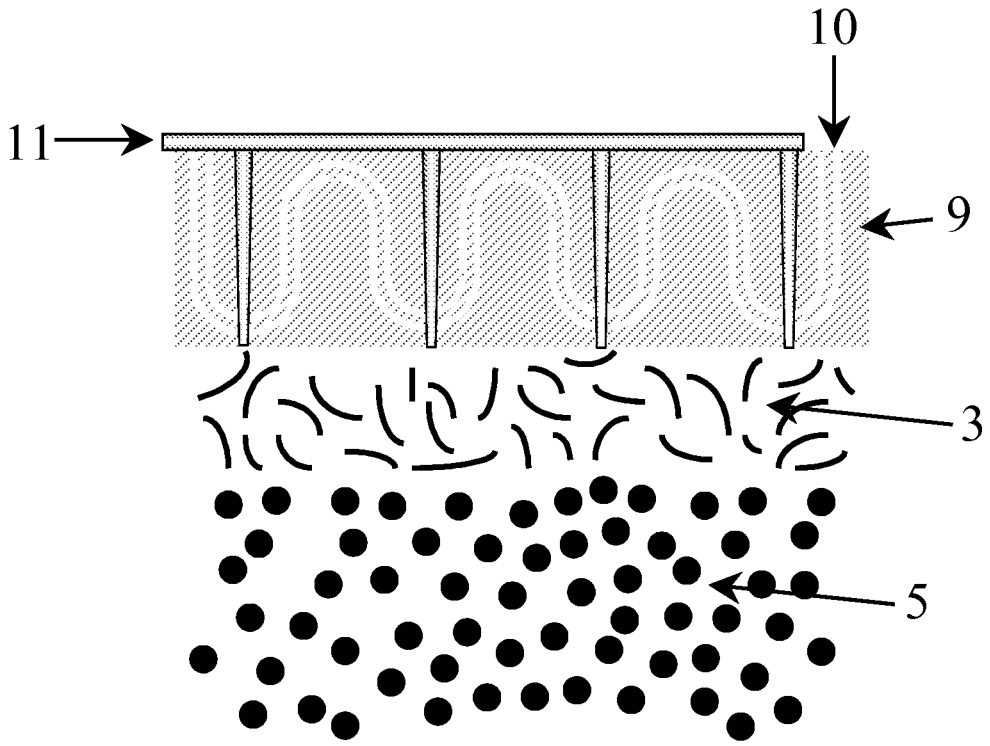

In another embodiment localized graphite morphology control agent may be introduced as a fluid after molten iron is cast into the mold. FIG. 3 shows a mold 9 with temperature control lines 10. The sulfurization agent may be introduced as a fluid via feed lines 11 after the desired latency period.

Preferably, the temperature control lines 10 retard the cooling rate where flake graphite morphology 3 is desired.

In another embodiment localized graphite morphology control agent may be introduced into the core as a liquid. This liquid may, for example, be sprayed onto the surface of a porous core before the core is assembled into the final mold.

It should be understood that the various embodiments described are methods that may be combined to achieve the best possible result. The combination of in-situ treatments and localized mold temperature control are expected to enable exceptional graphite morphology control and may be utilized to achieve the preferred depth of localized graphite morphology control at desired surfaces

INDUSTRIAL APPLICABILITY

Methods of controlling graphite morphology in cast iron articles are particularly applicable to components of heavy duty diesel engines. In particular, cylinder heads may be greatly benefited by localized graphite morphology control. The combustion temperature and combustion pressure of heavy duty diesel engines can cause large thermal stresses on cylinder heads. Therefore, it is desirable to have flake graphite cast iron near the flame deck for a cylinder head to help convey heat away from the region and withstand the high compressive stresses. Concurrently, it is beneficial to have ductile iron away from the flame deck to withstand the bending stress and tensile stress that comes from combustion pressures. As a second example, engine blocks may be greatly benefited by localized graphite morphology control. The piston rings sliding along the bore benefit by the inherent lubricity of the flake graphite in grey iron. Concurrently, some regions of the block, especially at the V-intersection of the banks on a V-engine, experience mechanical stresses that can be better endured by the mechanical fatigue strength of ductile iron.

What is claimed is:

1. A method for the production of a cast iron article comprising:

pouring molten iron with spheroidal graphite forming tendency into a mold wherein sulfurizing agent is positioned in areas of localized graphite morphology control;

said sulfurizing agent being positioned and selected such that an intentional latency period is achieved between pouring molten iron into the mold and sulfurizing agent introduction to the molten iron.

2. A method according to claim 1 further comprising:

sulfurizing agent positioned and selected such than the intentional latency period for sulfurizing agent introduction to the molten iron is between 10 and 150 seconds after pouring the molten iron.

3. A method according to claim 1 further comprising:

sulfurizing agent selected from one or more of iron pyrites, other iron sulfides, elemental sulfur, sulfur-containing organic molecules, sulfur containing acids, and sulfur-containing salts.

4. A method according to claim 2 further comprising:

sulfurizing agent selected from compounds that synergistically increase the effectivity of sulfur including oxidizers being selected from materials containing iron oxides, copper oxides, antimony oxides, and nickel oxides.

5. A method according to claim 4 further comprising:

oxidizers incorporated into a core wash that is disposed on the surface of a mold section.

6. A method according to claim 1 further comprising;

incorporating sulfurizing agent in a core material.

7. A method according to claim 6 further comprising:

covering said core material with a barrier layer.

8. A method according to claim 7 further comprising:

said barrier layer being a core wash without sulfur-containing material.

9. A method according to claim 1 further comprising:

localized mold temperature control to intentionally influence localized graphite morphology.

10. A method according to claim 9 further comprising:

accelerated mold cooling provided in regions where spheroidal graphite morphology is intended.

11. A method according to claim 9 further comprising:

retarded mold cooling provided in regions where flaky graphite morphology is intended.

12. A method according to claim 9 further comprising:

localized mold temperature control aids selected from metal heat sinks, temperature control lines, and low thermal conductivity inserts.

13. A method according to claim 1 further comprising:

sulfurizing agent positioned on a sheet that is attached to the surface of the mold.

* * * * *